US005364314A

United States Patent [19]

Burkholder et al.

[11] Patent Number: 5,364,314

[45] Date of Patent: Nov. 15, 1994

[54] MULTI-POSITION RUBBER PINSETTER DECK CHUTE

[75] Inventors: Roy A. Burkholder, Whitehall; Anthony J. Gretzky, Norton Shores, both of Mich.

[73] Assignee: Brunswick Bowling & Billiards Corporation, Muskegon, Mich.

[21] Appl. No.: 90,303

[22] Filed: Jul. 12, 1993

[51] Int. Cl.[5] ..... A63D 5/00

[52] U.S. Cl. ..... 473/94; 473/96

[58] Field of Search ..... 473/90, 91, 94, 95, 473/96

[56] References Cited

U.S. PATENT DOCUMENTS 3,172,662 3/1965 Boyle et al. ..... 473/94

3,232,611 2/1966 Fossberg ..... 473/94

OTHER PUBLICATIONS

Brunswick Service Bulletin No. 81-10, Subject: Deck Chute Installation Instructions.

Brunswick Drawing No. 12-200894.

*Primary Examiner*—V. Millin

*Assistant Examiner*—William M. Pierce

*Attorney, Agent, or Firm*—Wood, Phillips, VanSanten, Hoffman & Ertel

[57] ABSTRACT

A molded rubber pin chute for mounting on the pin deck of an automatic bowling pinsetter. The pin chute comprises an upper conical section which is canted with respect to the pin deck, a cylindrical lower body portion which extends into a pin receiving aperture in the pin deck, and a flange around the cylindrical body. A plurality of bolt holes selectively positioned in the flange permit the chute to be secured in at least six different radial positions upon the pin deck and thereby enhance its performance in guiding the bowling pins into apertures in the pin deck for receiving the same.

2 Claims, 2 Drawing Sheets

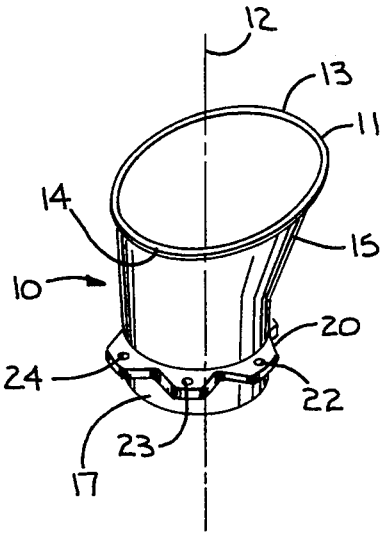
FIG. 1
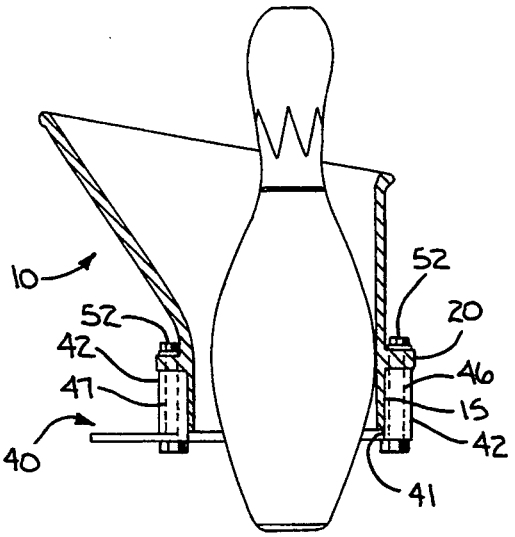
FIG. 5
FIG. 2
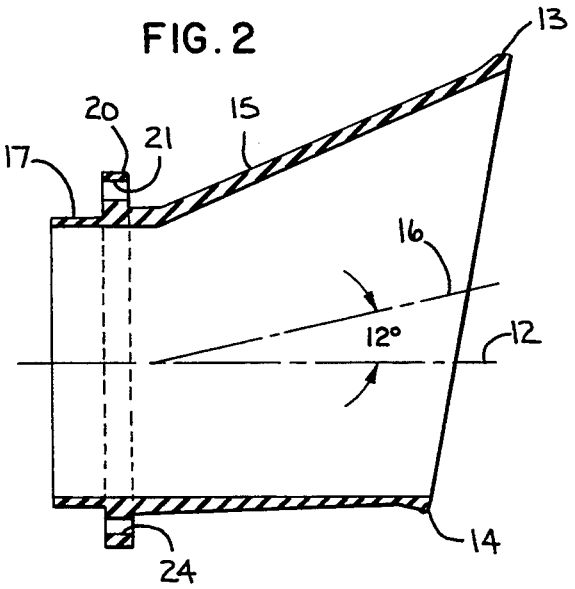
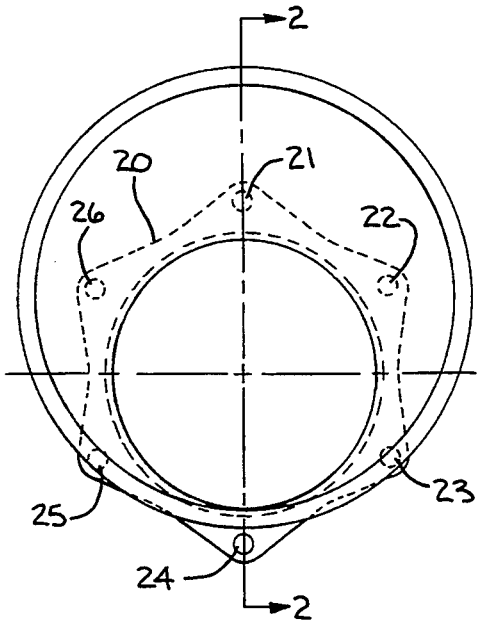
FIG. 3

MULTI-POSITION RUBBER PINSETTER DECK CHUTE

FIELD OF THE INVENTION

This invention is in the field of ten pin bowling equipment and relates specifically to an automatic pinsetting machine manufactured by Brunswick Corporation from approximately 1959 through 1989.

BACKGROUND OF THE INVENTION

In operation, a bowling pinsetter collects the fallen pins from the pit, elevates them into the top of the pinsetter, and distributes them to chutes (deck chutes) via which they are delivered to vacant positions in the pin deck. The function of the deck chute, as the name implies, is to aid in guiding the pin into position in the pin deck which will subsequently deliver it to a standing position on the bowling lane.

Because the pins are delivered to the deck chutes by a centrally located turret-like distribution system, the original funnel-shaped pin chutes were shaped and oriented in a manner most conducive to receive the pin and deliver it to the pin deck with a minimum of interference. Originally the chutes were made of non-marking rubber for durability and to absorb shock, reduce noise and avoid marking of the pins.

With use, it becomes necessary to periodically replace the chutes. Originally, replacement chutes were produced in five configurations, one each for pin positions 1; 5; 7 and 10; 2, 6 and 8; and 3, 4 and 9. In order to reduce the number of configurations that a service operation was required to maintain on hand, around 1976 Brunswick began offering an optional polypropylene universal chute that could be used in any of pin positions 2, 3, 4, 6, 8 and 9. This replacement chute could be mounted in three orientations, each 120° apart, to adapt it to one of the aforesaid positions. Unfortunately, this configuration did not permit these replacement chutes to match the orientations of those of the original design which in some cases resulted in inferior performance.

The present invention overcomes the shortcomings of the old design by making it possible to mount the replacement chutes in six different orientations 60° apart, as opposed to three for the prior art universal chutes, and thus enable it to more nearly match the orientation of the chutes originally designed for the pinsetter.

SUMMARY OF THE INVENTION

The invention is an improved universal deck chum for use on automatic pinsetters. The chute body includes an offset frustoconical upper portion and a cylindrical lower portion sized to closely fit through pin receiving apertures in the pin deck of the pinsetter. A retaining flange extends substantially around the circumference of the body of the chute and has a plurality of passages extending axially therethrough positioned to align with shoulders on the pin deck to which the chute is attached. The number and position of said passages permits the chute to be positioned with respect to a pin receiving aperture in at least six radial positions, each 60° apart. Consequently, this chute may be used at any one of pin positions 2, 3, 4, 6, 8 and 9 of the pin deck and be oriented in a preferred manner at each such position.

The chute is preferably a unitary piece which is injection molded of non-marking rubber.

BRIEF DESCRIPTION OF THE DRAWINGS

FIG. 1 is a perspective view of a pin chute of the invention;

FIG. 2 is a cross-sectional view of the pin chute of FIG. 1 taken along line 2—2' of FIG. 3;

FIG. 3 is a top view of the pin chute of FIG. 1;

FIG. 5 is a vertical cross-sectional view of the pin chute of FIG. 1 taken along line 2—2 of FIG. 3 and illustrating the same mounted upon one of the pin receiving apertures of the pin deck of FIG. 4.

DETAILED DESCRIPTION OF THE PREFERRED EMBODIMENT

Figure 4:
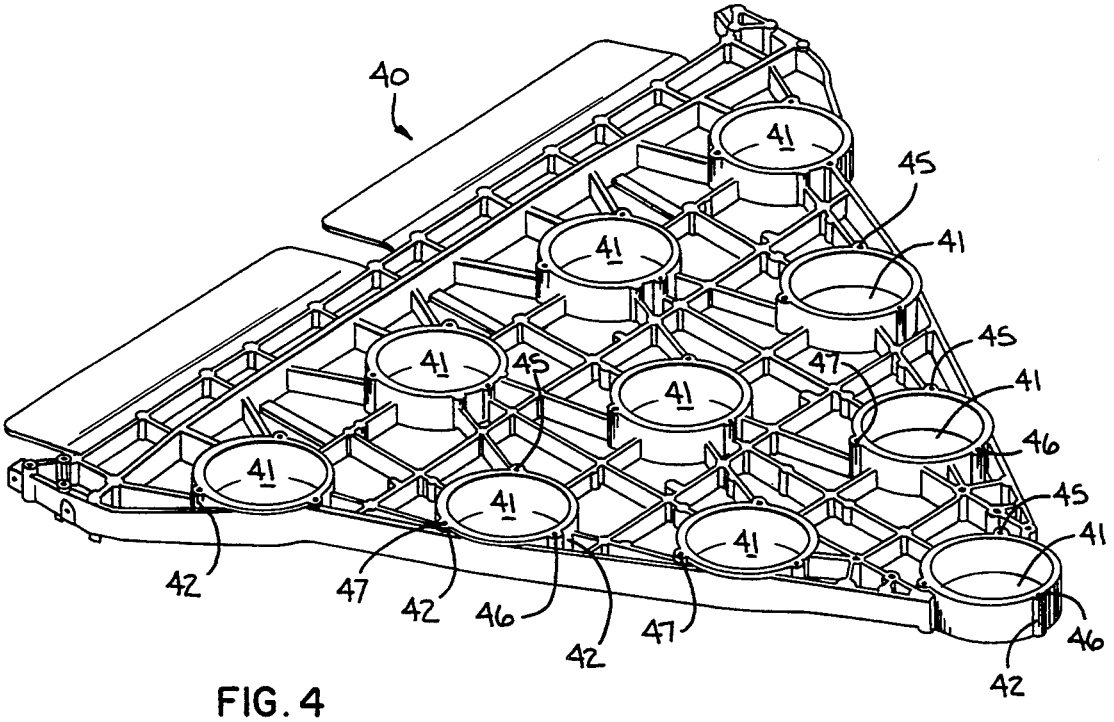
FIG. 4 is a perspective view of the basic structure of a pin deck for an automatic pinsetter taken from above and to the left.

Referring to FIG. 1, the pin chute 10 of the invention is comprised of a basic frustoconical upper body 15, a cylindrical lower body portion 17 and a flange 20 integrally molded with the body. The top edge 11 of the body 15 is slanted with respect to the longitudinal axis 12 of the chute 10 so that it has a point 13 furthest above the flange 20 and a point 14 closest to the flange 20.

Referring to FIGS. 2 and 3, the flange 20 of the invention has six holes therethrough for receiving fasteners. The six holes 21–26 are positioned at 60° increments around the circumference of the flange with one hole 24 positioned directly below the low point 14 of the top edge 11 of the body 15. Each hole comprises a bore through the flange 20 what is parallel to the axis 12 of the chute 10.

Referring to FIG. 4, the pin deck 40 is a cast aluminum triangle having ten pin receiving positions or apertures 41 therein sized to receive the deck chutes 10 and the bowling pins. Adjacent to each aperture 41 are shoulders 42 into which bolt holes 45, 46 and 47 are placed, the purpose of which is to accommodate bolts which hold the pin chute 10 in position upon the pin deck 40. The bolt holes 45, 46 and 47 are radially positioned at 120° intervals around the circumference of each aperture 41, with one of said holes being located on the fore and aft axis 50 of the aperture. Referring to FIG. 3, it will be apparent to those of reasonable skill in the art that the flange 20 can be fastened to the pin deck 40 in six different radial positions depending upon which of the six holes 21–26 are positioned over the three bolt holes 45–47 in the pin deck 40.

Referring to FIG. 5, a pin chute 10 is illustrated in position upon a pin deck 40. The cylindrical body portion 17 of the chute 10 extends downwardly through its associated aperture 41 in the pin deck 40 and the flange 20 rests upon the shoulders 42 on the pin deck 40. Bolts 52 extend through the flange 20 and may be threaded into or through the bores 45–47 in the shoulders 42.

The pin chute 10 of the invention is preferably injection molded by conventional means from a non-marking rubber commonly known as Nitrile rubber, sometimes referred to as NBR, manufactured by the Goodyear Tire and Rubber Company. The molded part then undergoes a chlorination treatment to reduce the coefficient of friction to the desired value of less than 0.28.

The resulting product is more slippery than the prior art polypropylene chutes and more durable affording the advantages of longer life for the chute and less abrasion of the pins.

Figure 6:
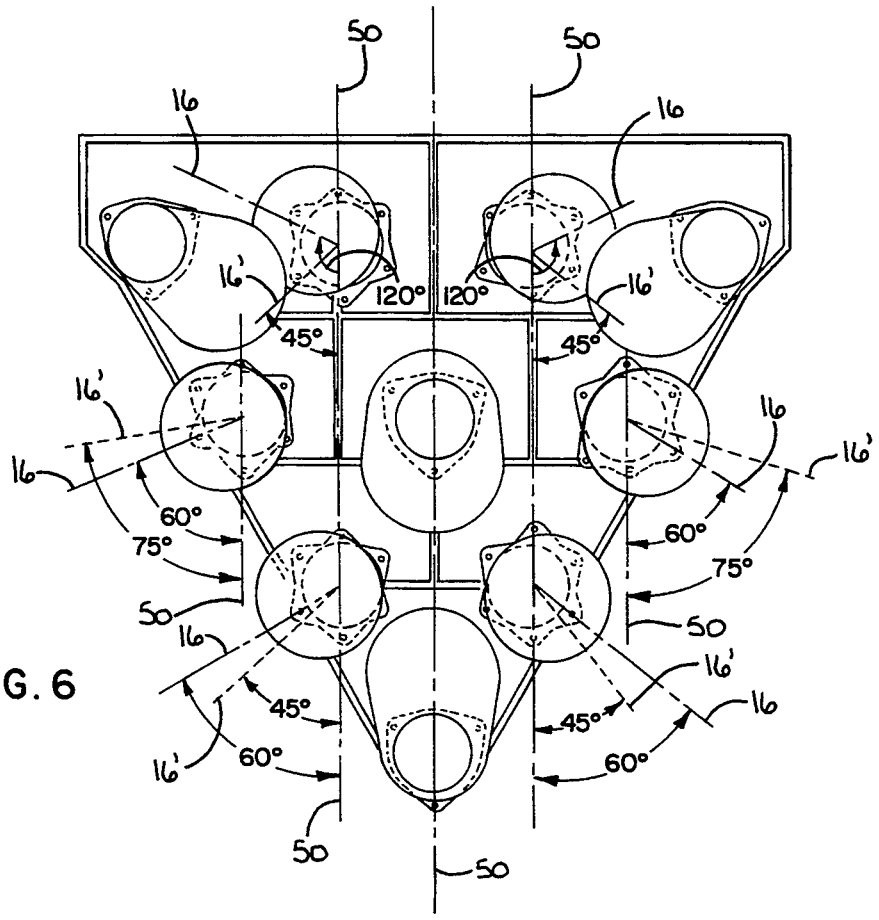
FIG. 6 is a top view of a pin deck of FIG. 4 with deck chutes of FIG. 1 installed thereupon in their preferred orientations at pin positions 2, 3, 4, 6, 8 and 9 on the pin deck.

Referring to FIG. 6, the preferred orientation of the pin chute 10 is illustrated for each of pin positions 2, 3, 4, 6, 8 and 9. FIGS. 2 and 3 illustrate that the upper body 15 of the chute 10 is in the shape of a cone, the axis 16 of which forms an angle of 12° with the centerline 12 of the lower cylindrical body 17, the flange 20 and thus the aperture 41 of the pin deck 40 within which the chute 10 is positioned. FIG. 6 illustrates the desired radial position of the axis 16 of each chute 10 in its preferred position on the deck 40, measured with respect to the fore and aft axis 50 of its receiving aperture 41. Since three of the six bolt holes 21–26 in the flange 20 must align with the three bores 45–47 in the deck 40, the positioning of the six holes 21–26 on the flange 20 is critical to the correct positioning of the chutes 10 on the pin deck 40. The chute 10 may be rotated 360° within its receive aperture 41 in the pin deck 40 and may be secured at 60° intervals where the respective bolt holes in the chute and the deck align, thus providing more possible positions in the alignment of the chute 10 upon the deck 40 than had been possible with the prior art.

FIG. 6 also indicates the orientation of pin chutes 2, 3, 4, 6, 8 and 9 according to the original design of the pinsetter. The location of the conical axis of the original chutes appears as dashed line 16' in FIG. 6. A comparison of the orientation of the axes 16 and 16' of the replacement and original chutes reveals that at pin positions 2, 3, 4 and 6, the axis of the replacement chute 10 is only displaced 15° from the original chute position. The greatest disparity in positions occurs at pin positions 8 and 9 when the difference is 75°. By comparison, the replacement chute of the prior art had to be mounted in an orientation with its axis 16 45° from the position of the axis 16' of the original equipment chute at pin positions 2 and 3, and 75° from the axis 16' of the original equipment chute at pin positions 4, 6, 8 and 9.

It will be understood that the invention may be embodied in other specific forms without departing from the spirit or central characteristics thereof. The present examples and embodiments, therefor, are to be considered as illustrative and not restrictive, and the invention is not to be limited to the details given herein.

We claim:

1. An improved universal pin deck chute for an automatic pinsetter having a pin deck with a plurality of pin receiving apertures therein, means for delivering pins to said pin receiving apertures and a deck chute associated with each pin receiving aperture to guide a delivered pin into the aperture, said pin deck having three shoulder means positioned adjacent to an spaced at 120° intervals around the periphery of each pin receiving aperture for attachment to said deck chute, and means for attaching said deck chute to said shoulder attachment means;

said deck chute having a cylindrical lower portion adapted to fit within said pin receiving apertures and a frustoconical upper portion, the vertical axis of which intersects the axis of the lower portion at an acute angle;

the improvement comprising:

a retaining flange extending outwardly and disposed substantially around the cylindrical portion of the deck chute, said flange having at least six passages extending axially therethrough and spaced at 60° radial intervals around the flange, whereby the chute may be attached to the pin deck at any of the pin receiving apertures in six different pin receiving radial positions with three of said axial passages aligned with said three shoulder means.

2. In an automatic bowling pinsetter having a pin deck with ten pin receiving positions therein, means for delivering bowling pins to said pin receiving positions, rubber deck chute means for guiding pins from said pin delivery means into said pin receiving positions and means for fastening the deck chutes to the pin deck, wherein each pin receiving position of said pin deck comprises at least three shoulder portions having axial bores therethrough radially spaced 120° apart and adapted to receive said fastening means; an improved rubber deck chute comprised of a body having a cylindrical portion configured to closely fit within the cylindrical aperture of said pin receiving portions, a frustoconical portion extending upwardly and tilted with respect to said cylindrical portion and a retaining flange means extending substantially around said cylindrical portion for attachment to said pin deck fastening means, said flange having at least six axial bores therein radially spaced 60° apart, so that at least three of said bores in said flange will align with the three bores in the pin deck when the chute is in any one of six preselected radial pin receiving orientations on the pin deck.

* * * * *